US006035560A

United States Patent [19]

Pender

[11] Patent Number: 6,035,560

[45] Date of Patent: Mar. 14, 2000

[54] AIR DEFLECTOR WITH ADJUSTABLE LOUVER FOR SNOW PLOW

[76] Inventor: Gerald R. Pender, 209 E. River St., Ontonagon, Mich. 49953

[21] Appl. No.: 08/856,527

[22] Filed: May 14, 1997

[51] Int. Cl.[7] ..... E01H 5/04

[52] U.S. Cl. ..... 37/231; 37/241; 403/379; 296/180.5

[58] Field of Search ..... 37/266, 275, 241, 37/221, 233, 231; 180/68.1; 296/180.1, 91, 180.5; 403/378, 379; 248/221.11

[56] References Cited

U.S. PATENT DOCUMENTS

| | | | |
|---|---|---|---|
| 3,175,453 | 3/1965 | Williams | 403/379 X |
| 3,353,852 | 11/1967 | Wood | 403/379 X |
| 4,178,034 | 12/1979 | Mittendorf | 296/91 |
| 4,379,582 | 4/1983 | Miwa | 296/91 X |
| 4,587,750 | 5/1986 | Larson . | |
| 4,776,627 | 10/1988 | Hutto et al. | 296/91 |
| 4,896,915 | 1/1990 | Morandi et al. . | |
| 4,929,013 | 5/1990 | Eke | 296/91 |
| 5,309,653 | 5/1994 | Pease et al. | 37/266 |
| 5,544,434 | 8/1996 | Calvachio, Jr. . | |
| 5,688,020 | 11/1997 | Burg | 296/180.1 |

*Primary Examiner*—H. Shackelford

[57] ABSTRACT

An air deflector assembly with an adjustable louver for use with a snow plow mounted on a vehicle is provided. The deflector assembly includes a base mounted to the plow, an air scoop detachably mounted on the base and a louver located at the rear of the air scoop. The louver is pivotally secured to the air scoop to deflect the wind onto the vehicle's radiator. A mounting arrangement is also provided to detachably mount the air deflector assembly with the snow plow. The mounting arrangement allows the air scoop and louver to be quickly mounted on and removed from the snow plow.

13 Claims, 1 Drawing Sheet

AIR DEFLECTOR WITH ADJUSTABLE LOUVER FOR SNOW PLOW

TECHNICAL FIELD

The invention relates to an air deflector assembly including an adjustable louver for use with a snow plow attached to the front of a vehicle. Specifically, the invention relates to an air deflector which is able to direct air to the radiator of the vehicle when the snow plow is in the raised position.

BACKGROUND ART

Snow plow blades are typically mounted on the front of motor vehicles, such as trucks and jeeps in cold weather climates for conducting snow plowing operations. One problem that arises when using a snow plow blade mounted on the front of a vehicle is that when the plow blade is in a non-plowing or up position, the snow plow blade is situated such that it is in front of the vehicle, and in particular, in front of the radiator, and blocks the flow of air to the vehicle's radiator. As a result, the amount of air passing over the radiator is greatly reduced, which results in over heating of the vehicle.

There are prior art air flow deflectors that direct the flow of air over top of the snow plow blade onto the vehicle radiator. One such air flow deflector is shown in U.S. Pat. No. 5,544,434 to Calvachio, Jr. Another type of arrangement is shown in U.S. Pat. No. 4,587,750 to Larson. The devices as shown in the Calvachio and Larson patents basically constitutes pivotable fins mounted on top of the blade. The entire air scoop arrangement must be pivoted to direct the flow of air to the vehicle's radiator.

Yet, another type of wind deflector plate is shown in U.S. Pat. No. 4,896,915 to Morandi et al. The Morandi patent discloses a different type of arrangement having a wind deflector mounted to a plow pump and having a laterally movable extension plate movable between the air scoop assembly and the vehicle to direct the flow of air to the vehicle radiator.

SUMMARY OF THE INVENTION AND ADVANTAGES

According to the present invention, there is provided an air deflector assembly adapted for use on a snow plow that is adapted to be mounted on a motor vehicle. The deflector assembly comprises a base adapted to be fixed to the snow plow blade. An air scoop is connected to the base and defines an air passageway having a front and rear openings. The assembly includes an adjustable louver pivotally attached to the air scoop in proximity to the rear opening of the air scoop.

According to the present invention, there is provided an air deflector assembly that allows for detachable mounting of an air scoop with a snow plow blade. Further, the air scoop portion of the deflector assembly remains in a fixed position relative to the snow plow blade. An adjustable louver is positioned on the scoop assembly at the rear thereof to direct the flow of air. This arrangement provides for stable mounting on all types of snow plow blades having any top angle. The necessary wind deflection onto the vehicle's radiator is provided by merely pivoting the adjustable louver.

The present invention also provides a quick and stable attachment mechanism for detachably attaching the air scoop assembly with the snow plow.

BRIEF DESCRIPTION OF THE DRAWINGS

Other advantages of the present invention will be readily appreciated as the same becomes better understood by reference to the following detailed description when considered with the accompanying drawings wherein.

PREFERRED EMBODIMENT OF THE INVENTION

Figure 1:
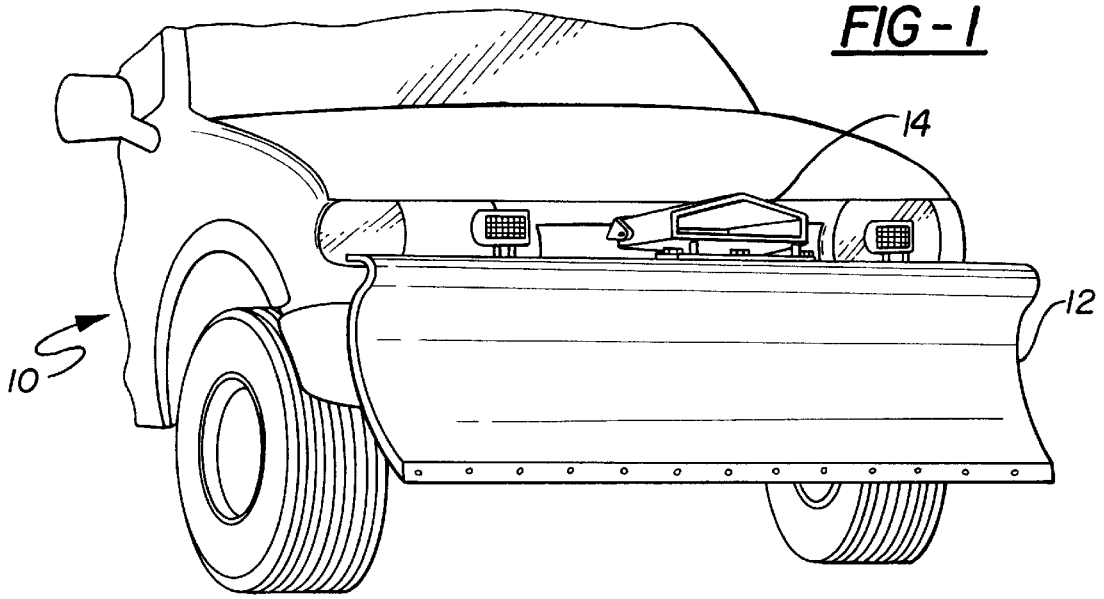
FIG. 1 is a perspective view partially broken away of a vehicle having a snow plow and incorporating the air deflection assembly made in accordance with the instant invention.
Figure 2:
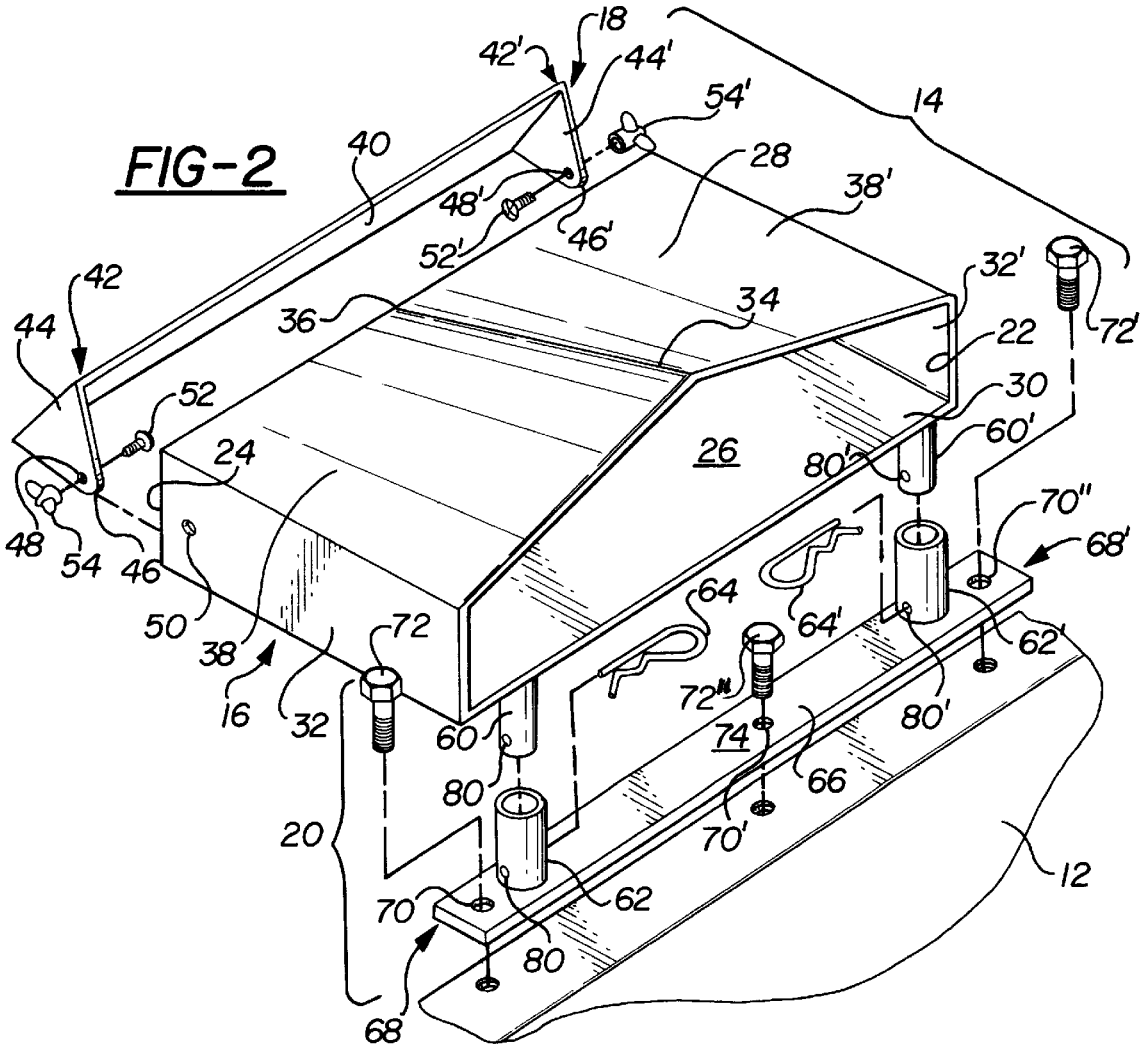
FIG. 2 is exploded view of the air deflector assembly.

A vehicle with an attached snow plow (while the terminology "plow" is used it more specifically refers to the plow blade) is generally shown at 10. The vehicle includes a front mounted radiator (not shown). The snow plow 12 generally moves between a down (plowing ) position where it is used to move snow and an up (nonplowing) position when the plow is not in use. Typically, when in the up position, the plow 12 impedes the flow of air over the vehicles radiator. An air deflector generally indicated at 14 in FIGS. 1 and 2 is detachably mounted on the snow plow 12. The air deflector assembly 14 is adapted to collect air passing over the snow plow 12 and direct the air flow over the vehicle's radiator when the plow 12 is in the up position.

The air deflector assembly comprises an air scoop generally indicated at 16, a louver generally indicated at 18, and an attachment assembly generally indicated at 20.

The scoop 16 has a tubular configuration that defines front 22 and rear 24 openings. As the scoop 16 is tubular it also defines an air passageway 26. The front opening 22 of the passageway 26 gathers air and directs air from the front of the plow through the passageway 26 to the rear opening 24.

In the preferred embodiment, the scoop 16 includes a top surface 28, a bottom 30, and a pair of side walls 32, 32'. The front opening 22 is pentagonal in shape. The top surface 28 of the scoop 16 comes to a peak 34 at the center of the front opening 22 and gradually is less pronounced toward the rear opening 24 where the top essentially becomes a flat surface 36. Thus, the passageway 26 may taper slightly from the front opening 22 to the rear opening 24. The front opening 26 thus has a longer cross-sectional area than the rear opening 24.

The top surface 28 comprises a pair of opposing downwardly depending top surfaces 38, 38' from the peak 34. Each of these top surfaces 38, 38' are fixed, at their respective outboard ends to opposing side walls 32, 32'. The bottom 30 is preferably flat and connects the opposing side walls 32, 32'. The bottom 30 is connected to the side walls 32, 32' at the opposite end than the top 28. Together, the top surfaces 38, 38', side walls 32, 32' and bottom 30 comprise the scoop and define the passageway 26 therebetween.

It will be appreciated that the scoop 16 of the present invention may take any shape that allows the scoop 16 to be mounted to the plow 12. The scoop 16 must be capable of directing air from the front of the plow to the rear thereof.

The louver 18 is pivotally attached near the rear opening 24 of the air scoop 16. The louver is adapted to be adjusted such that it is capable of directing air leaving the rear opening 24 of the scoop 16 in the direction of the radiator when the snow plow is in the up position. Furthermore, in some situations, the snow plow 12 may also block the flow of air to the vehicle radiator when the plow is in the down or plowing position. In this situation, the louver 18 can simply be readjusted, without the need to readjust the entire deflector assembly, to direct the flow of air over the vehicle radiator. This ensures that the radiator receives adequate cooling while the snow plow is in its various positions.

In the preferred embodiment, the louver 18 comprises an air directing portion 40 which is rectangular in shape and includes a pair of ends 42, 42'. A mounting flange 44, 44' depends substantially perpendicularly from each end 42, 42', respectively. As shown, the mounting flanges 44, 44' are basically triangular and extend from a relatively wide base to a relatively narrow apex. The flanges 44, 44' and directing portion preferably form a unitary structure. However, it is to be understood that the louver 18 can be of my configuration and any suitably durable material that is capable of being pivotally mounted on or in the proximity of the rear opening 24 of the air scoop 16 to direct the flow of air from the scoop 16 to the vehicle radiator.

As stated above, each flange 44, 44' has an apex 46, 46' which has a hole 48, 48' therethrough. Each side wall 32, 32' of the scoop 16 includes a corresponding hole 50 where the louver 18 is attached via fasteners 52, 52'. In the preferred embodiment, threaded fasteners 52, 52' are utilized in conjunction with wing nuts 54, 54' thereby allowing easy manual adjustment of the louver 18 without requiring any tools.

A bolt 52, 52' is inserted through the hole 50, 50' from the inside of the scoop 16. The bolt 52, 52' then passes through respective holes 48, 48' on each of the flanges 44, 44'. The wing nut 54, 54' is then tightened on each of the bolts 52, 52' to lock the louver 18 with respect to the air scoop 16. Adjusting the louver 18 is then simply accomplished by loosening the wing nuts 54, 54', pivoting the louver 18 and then retightening the wing nuts 54, 54'. It will be appreciated that any different fastening devices may be used to secure the louver 18 with respect to the air scoop 16 while retaining the ability to allow pivotal adjustment of the louver 18.

The attachment assembly 20 is adapted to allow the scoop 16 to be detachably mounted to the snow plow 12. The attachment assembly comprises a pair of scoop connectors 60, 60', a pair of base connectors 62, 62', a pair of retaining clips 64, 64', and a base 66.

In the preferred embodiment, the base 66 comprises a generally rectangular plate having two extremities. Each extremity has a hole to receive fasteners 72, 72' to thereby fix the base 66 to the top of the snow plow 12. Threaded fasteners 72, 72', 72" such as bolts, are preferable for this purpose, although any type of suitable fasteners may be used to serve the base 66 with the snow plow 12. A corresponding nut (not shown) is used on underside of the snow plow to secure the base thereto. It will be appreciated that the base 66 need not have any holes or utilize any fasteners and may simply be welded or otherwise secured to the top of the snow plow.

The base further includes a top surface 74. A pair of base connectors 62, 62' extend upwardly from the top surface 74. In the preferred embodiment, the base connectors comprise a hollow cylindrical tube defining an upwardly facing opening.

Each hollow tube 62, 62' is adapted to receive a cylindrical scoop connector 60, 60', respectively. The scoop connectors 60, 60' depend from the bottom 30 of the scoop 16 and mate with the hollow tube 62, 62'. The base connectors 62, 62' and scoop connectors 60, 60' are each oriented in relation to one another such that they are in alignment about a common longitudinal axis. As set forth above, in the preferred embodiment, the base connectors 60, 60' are a solid cylindrical (or male) pin and the scoop connectors comprises a hollow cylindrical (or female) tube. This configuration allows the base 62, 62' scoop 60, 60' connectors to interconnect and be retained in a fixed lateral position.

It will be appreciated that the base connectors 62, 62' and scoop connectors 60, 60' may take any configuration that allows the scoop 16 to be detachably mounted with the plow 12. Furthermore, the orientation of the scoop connectors and the base connectors 62, 62' can be reversed. That is, the scoop connectors can be hollow (female) to receive solid (male) base connectors.

It will also be appreciated that in lieu of an entire assembly, the base connectors 62, 62' may be fixedly secured to the plow 12 at predetermined spaces. In this manner, the base comprises only the base connectors 62, 62'.

To fix the air scoop 16 in the vertical direction with respect to the plow, retaining clips 64, 64' are used. That is, each pair of scoop 60, 60' and base 62, 62' connectors has a connecting hole 80, 80' therethrough that is traverse to their respective longitudinal axis. The connecting holes 80, 80' through the respective scoop connectors 60, 60' and base connectors 62, 62' are coaxial when the scoop connector 60, 60' is fully inserted in the base connector 62, 62'. The retaining clip 64, 64' is then inserted into the coaxial hole 80, 80' thereby securely locking the scoop 16 onto the base 66. With a connection of this type, the scoop 16 is detachably mounted on the plow 12, can easily be removed and attached to the top of the snow plow.

It is to be understood that any number of scoop and base connectors may be used within the scope of the present invention. Further, the connectors may be oriented at any angle suitable at which the scoop may be removably attached the base.

While in the preferred embodiment the air scoop 16, louver 18 and attachment assembly 20 are constructed of metal, it will be appreciated that any material may be used within the context of the present invention.

In operation, the air deflector assembly 14 is affixed to the snow plow blade by first affixing the base 66 with a plurality of threaded fasteners 72, 72', 72" through a pair of corresponding holes on the top surface of the snow plow 12. Once the base 66 has been affixed to the blade 12, the air scoop 16 is secured to the base. This is accomplished by positioning the male scoop connector 60, 60' inside the female base connectors 62, 62' until the connection holes 80 are aligned. A pair of retaining clips 64, 64' are then inserted through each of the respective openings 80 to thereby lock the air scoop 16 relative to the base 66.

The wing nuts 54 can then be loosened to allow pivotal movement of the louver 18 with respect to the scoop 16. The louver 18 is pivoted until the desired direction for the air flow has been achieved. The wing nuts 54 are then retightened, and the air scoop assembly 14 is now ready for use.

In use, air is collected through the front opening 26 in the air scoop 16. The air is channeled through the passageway 26 of the air scoop 16 and out the rear opening 24. The air passing through the air scoop is then deflected by the plate 40 of the louver 18 to the vehicle radiator.

Adjustment of the direction of the air flow is controlled simply by loosening the wing nuts 54 and adjusting the position of the plate 40 and then retightening the wing nuts 54. To remove the scoop assembly from the snow plow 12, the retaining clips 64, 64' are removed, and the air scoop assembly 14 is simply lifted until the scoop connector 60, 60' are removed from the base connector 62, 62'.

The invention has been described in an illustrative manner, and it is to be understood that the terminology which has been used is intended to be in the nature of word of description rather than limitation.

Obviously, many modifications and variations of the present invention are possible in the light of the above teachings. It is, therefore, to be understood that within the scope of the appended claims the invention may be practiced otherwise than specifically described.

I claim:

1. An air deflector assembly adapted for use with a snow plow adapted to be mounted on a motor vehicle comprising:

a base adapted to be fixed to the snow plow;

an air scoop connected to said base, said air scoop defining an air passageway having a front opening and a rear opening; and an adjustable loader pivotally attached to said air scoop in proximity to said rear opening of said air scoop and capable of being secured to prevent relative movement between said louvre and said air scoop when said assembly is in use, said louver comprising an air direction portion having opposing ends, and a mounting flange on each or said opposing ends and wherein each of said mounting flanges extend transversely to to said air directing portion and is adapted to be pivotally attached said air scoop.

2. An assembly as set forth in claim 1 wherein said air scoop is tubular and defines a bottom surface.

3. An assembly as set forth in claim 2 wherein said tubular air scoop includes a peaked top surface having a pair downwardly depending surfaces, a pair of opposing side walls, said side walls, depending from each of said top surfaces, said bottom extending between said side walls.

4. An assembly as set forth in claim 3 wherein said air scoop tapers downward in cross-section from said front opening to said rear opening whereby said front opening has a larger cross-sectional area than said rear opening.

5. An assembly as set forth in claim 3 wherein said louver is pivotally attached to said air scoop via at least one fastener passing through said mounting flange of said louver and said side wall of said air scoop.

6. An assembly as set forth in claim 2 wherein said base is generally rectangular in shape and defines a pair of extremities, said base being attached to the snow plow via fasteners positioned at least at said extremities.

7. An assembly as set forth in claim 6 wherein said base includes at least one base connector extending therefrom, and said bottom surface of said air scoop includes at least one scoop connector extending therefrom to engage said base connector.

8. An assembly as set forth in claim 7 wherein said base connector comprises a hollow tube defining an upwardly facing opening therein and said scoop connector comprises a cylinder depending from said bottom surface and adapted to be received within said upwardly facing opening.

9. An assembly as set forth in claim 8 wherein each of said hollow tube and said cylinder include a connecting hole therethrough, said connecting hole being coaxial when said cylinder is received in said hollow tube, and being transverse to the longitudinal axis of said cylinder and said tube, said hole adapted to receive a retainer to secure said cylinder within said tube, and thereby secure said air scoop with the snow plow.

10. An air scoop assembly adapted to be detachably mounted on a snow plow of a vehicle comprising:

an air scoop;

a base adapted to be fixed to the snow plow; and an attachment mechanism to detachably mount said air scoop onto said base, said attachment mechanism having at least one scoop connector and a least one base connector, said scoop connector being integral with said air scoop and extending downwardly therefrom and said base connector integral with said base and extending upwardly therefrom, one of said scoop connector and said base connector comprising a post, and the other of said scoop connector and said base connector comprising a receiver for receiving said post in mating engagement.

11. An assembly as set forth in claim 10 wherein said base connector comprises said receiver which comprises a hollow tube defining an upwardly facing opening therein and said scoop connector comprises said post which comprises a cylinder depending from said air scoop and adapted to be received within said upwardly facing opening.

12. An assembly as set forth in claim 10 wherein both said scoop connector and said base connector include a connecting hole therethrough, said connecting hole being coaxial when said scoop connector and said base connector are in mating engagement and being transverse to the longitudinal axis of said scoop connector and said base connector, said hole adapted to receive a retainer to detachably retain said connectors in matings engagement and thereby secure said air scoop to the snow plow.

13. An assembly as set forth in claim 10 wherein said scoop connector comprises said receiver which comprises a hollow tube defining a downwardly depending opening from said air scoop and said base connector comprises said post which comprises an upwardly facing cylinder adapted to be received within said downwardly depending opening.

* * * * *